US006630920B1

(12) United States Patent
Maekawa et al.

(10) Patent No.: US 6,630,920 B1
(45) Date of Patent: Oct. 7, 2003

(54) PEL DRIVE CIRCUIT, COMBINATION PEL-DRIVE-CIRCUIT/PEL-INTEGRATED DEVICE, AND LIQUID CRYSTAL DISPLAY DEVICE

(75) Inventors: Toshikazu Maekawa, Kanagawa (JP); Kazuhiro Noda, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/285,784

(22) Filed: Apr. 5, 1999

(30) Foreign Application Priority Data

Apr. 7, 1998 (JP) ..... P10-094508

(51) Int. Cl.[7] ..... G09G 3/36

(52) U.S. Cl. ..... 345/100; 345/98; 345/99; 345/208; 377/75

(58) Field of Search ..... 345/87, 98, 99, 345/100, 204, 208, 213; 377/76, 75, 64, 69

(56) References Cited

U.S. PATENT DOCUMENTS

| | | | | | |
|---|---|---|---|---|---|
| 4,264,872 | A | * | 4/1981 | Suzuki | 330/253 |
| 4,396,845 | A | * | 8/1983 | Nakano | 326/70 |
| 5,222,082 | A | * | 6/1993 | Plus | 377/79 |
| 5,410,583 | A | * | 4/1995 | Weisbrod et al. | 377/75 |
| 5,434,899 | A | * | 7/1995 | Huq et al. | 377/78 |
| 5,517,542 | A | * | 5/1996 | Huq | 377/78 |

* cited by examiner

*Primary Examiner*—Kent Chang
(74) *Attorney, Agent, or Firm*—Rader, Fishman & Grauer PLLC; Ronald P. Kananen, Esq.

(57) ABSTRACT

To readily realize a reduction in pel pitch and an increase in the number of pels, a V shift register is configured such that one pulse transfer stage is provided so as to correspond to two horizontal pel lines constituting a pel section of a liquid crystal panel. Further, a decoder decodes a signal output from each pulse transfer stage of the V shift register, thereby preparing a gate pulse for individually driving the pel line. The number of pulse transfer stages is made half that of a conventional pel drive circuit.

6 Claims, 13 Drawing Sheets

FIG.5A VCK
FIG.5B 2VST
FIG.5C 2VCK
FIG.5D SRP1
FIG.5E SRP2
FIG.5F SRP3
FIG.5G VCK-A
FIG.5H VCK-B
FIG.5I GP1
FIG.5J GP2
FIG.5K GP3
FIG.5L GP4
FIG.5M GP5
FIG.5N GP6
t1
t2

FIG.7A VST
FIG.7B VCK
FIG.7C SRP1″
FIG.7D SRP2″
FIG.7E SRP3″
FIG.7F SRP4″
FIG.7G SRP5″
FIG.7H SRP6″
FIG.7I GP1
FIG.7J GP2
FIG.7K GP3
FIG.7L GP4
FIG.7M GP5
FIG.7N GP6

FIG.9A VCK
FIG.9B 2VST
FIG.9C 2VCK
FIG.9D SRP1
FIG.9E SRP2
FIG.9F SRP3
FIG.9G 2VCK-A
FIG.9H 2VCK-B
FIG.9I GP1
FIG.9J GP2
FIG.9K GP3
FIG.9L GP4
FIG.9M GP5
FIG.9N GP6
t1
t2

FIG.11A VCK
FIG.11B 3VST
FIG.11C 3VCK
FIG.11D SRP1'
FIG.11E SRP2'
FIG.11F SRP3'
FIG.11G VCK-A'
FIG.11H VCK-B'
FIG.11I VCK-C'
FIG.11J GP1
FIG.11K GP2
FIG.11L GP3
FIG.11M GP4
FIG.11N GP5
FIG.11O GP6

PEL DRIVE CIRCUIT, COMBINATION PEL-DRIVE-CIRCUIT/PEL-INTEGRATED DEVICE, AND LIQUID CRYSTAL DISPLAY DEVICE

BACKGROUND OF THE INVENTION

1. Field of the Invention

The present invention relates to a pel (i.e.,picture element, or pixel) drive circuit for selectively driving pels arranged in a matrix configuration, to a combination pel-drive-circuit/pel-integrated device comprising the pel drive circuit, and to a liquid display device incorporating the combination pel-drive-circuit/pel-integrated device.

2. Description of the Related Art

Recently, liquid crystal display devices have come into use as image display devices matching the performance of cathode-ray tubes (CRTs). The liquid crystal display device comprises pels arranged in the horizontal and vertical directions so as to form a matrix, and shift registers disposed in each of the horizontal and vertical directions. A vertical selection pulse signal is output from the vertical shift register while being sequentially shifted in the vertical direction. Every time a pel line (a row of pels aligned in the horizontal direction) is selected, a horizontal shift register outputs a horizontal selection pulse signal while being sequentially shifted in the horizontal direction. Pels of the pel line selected by the vertical selection pulse are scanned and sequentially selected. Through repetition of the foregoing operations, video signals are written into all the pels.

In the field of image display devices of this type, there is also known a multi-scan-compatible display device whose display area can be changed according to the type of a video signal in order to be able to cope with video signals complying with various standards, in the same way as does an image display device using a CRT. Under the method employed by the image display device of such a type, a non-display area (e.g., top and bottom margins of the screen) of the screen is made dark by not supplying the vertical selection pulse, thereby adjusting the size of a display area. This method eliminates a necessity for modifying the video signal itself, yielding the advantage of eliminating necessity for a control circuit or image memory for processing a video signal, as well as reducing the degree of increase in cost.

In the conventional image display device set forth, transfer stages in the vertical shift register are provided so as to correspond to the respective vertical pel lines. Pulses are shifted and output in the vertical direction one by one. The recent tendency for pursuit of a further reduction in pel pitch in association with a demand for a display image of higher definition complicates an attempt to form one transfer stage of the shift register within an area equal to that occupied by one pel line, which has conventionally been feasible. Even if such a high-density layout of transfer stages of the shift register becomes possible as a result of improvement in the technology for miniaturizing a semiconductor element, in a case where transfer stages of the shift register are provided for respective pel lines, the total number of semiconductor elements, such as transistors, required for constituting the entire shift register cannot be diminished, and hence the amount of electric current consumed by the shift register cannot be reduced. Further, in a case where a pulse is transferred in the shift register on a per-pel-line-basis, as in the case with the conventional image display device, an attempt to increase the number of pel lines involves a necessity for increasing the rate at which a pulse is transferred among transfer stages in the shift register. For this reason, the operating speed of semiconductor elements constituting a circuit of each transfer stage or a circuit of other portions must be increased; i.e., a drive frequency used for activating the semiconductor elements must be increased to a greater extent.

In the previously-described conventional multi-scan display device, an open-close switching element is provided for each of pel lines in the non-display area of the entire screen in order to interrupt the supply of a selection pulse to these pel lines. As a result, the number of elements used for each transfer stage is increased, which in turn increases the amount of electric current dissipated by the overall drive circuit. Particularly, under the current situation in which a further reduction in pel pitch is desired, provision of a switching element for each pel line is almost impossible, because forming a circuit for one transfer stage of the shift register within an area equal to that occupied by one pel line is nearly impossible.

As mentioned above, the conventional image display device encounters a problem in further reducing pel pitch and increasing the number of pels and suffers a necessity for increasing operating speed of elements constituting a drive circuit,

SUMMARY OF THE INVENTION

The present invention has been conceived in view of the foregoing problems, and the object of the present invention is to provide a pel drive circuit, a combination pel-drive-circuit/pel-integrated device, and a liquid display device incorporating the combination pel-drive-circuit/pel-integrated device, which readily enable a reduction in pel pitch and an increase in the number of pels without involvement of a necessity for increasing operating speed and the number of constituent elements for drive purposes.

According to a first aspect of the present invention, there is provided a pel drive circuit for driving a plurality of pels arranged in two different directions, comprising: pulse shift means which sequentially outputs a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions. Here, the pel drive circuit may further comprise changeover means which is provided between the pulse drive means and the individual drive pulse generation means and which can selectively effect supply of the first pulse signal received from the pulse shift means, to the individual drive pulse generation means.

According to another aspect of the present invention, there is provided a combination pel-drive-circuit/pel-integrated device, comprising: a plurality of pels arranged in two different directions; pulse shift means for sequentially outputting a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions. The combination pel-drive-circuit/pel-integrated device may further comprise changeover means which is provided between the pulse drive means and the individual drive pulse generation means and which can selectively effect supply of the first pulse signal received from the pulse shift means, to the individual drive pulse generation means.

According to still another aspect of the present invention, there is provided a liquid crystal display device comprising: a first substrate on which a plurality of pels are arranged in two different directions and on which a drive circuit is formed around the plurality of pels, a second substrate placed so as to oppose and be spaced a given interval away from the first substrate; and a liquid crystal layer held between the first and second substrates, wherein the drive circuit comprises: pulse shift means for sequentially outputting a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions.

The liquid crystal display device may further comprise changeover means which is provided between the pulse drive means and the individual drive pulse generation means and which can selectively effect supply of the first pulse signal from the pulse shift means, to the individual drive pulse generation means.

In the pel drive circuit, the combination pel-drive-circuit/pel-integrated device, and the liquid crystal display device according to the present invention, the pulse shift means sequentially outputs a first pulse signal while shifting the first pulse signal in one of the two directions in units comprising a plurality of pels. The individual drive pulse generation means generates, on the basis of the first pulse signal output from the pulse shift means, second pulse signals for individually driving pel lines arranged in the other of the two directions. Further, changeover means is provided between the pulse drive means and the individual drive pulse generation means and can selectively supply the first pulse signal from the pulse shift means, to the individual drive pulse generation means. As a result, the range of effective pel lines of the pel lines arranged in the other direction, i.e., an active display area, can be switched.

Other and further objects, features, and advantages of the present invention will become more apparent from the following description.

DETAILED DESCRIPTION OF THE PREFERRED EMBODIMENT

Preferred embodiments of the present invention will be described in detail hereinbelow by reference to the accompanying drawings. In the following description, the present invention will be described with reference to a color liquid crystal device comprising a pel section and pel drive circuit, both of which are integrally formed on a single board.

[First Embodiment]

Figure 1:
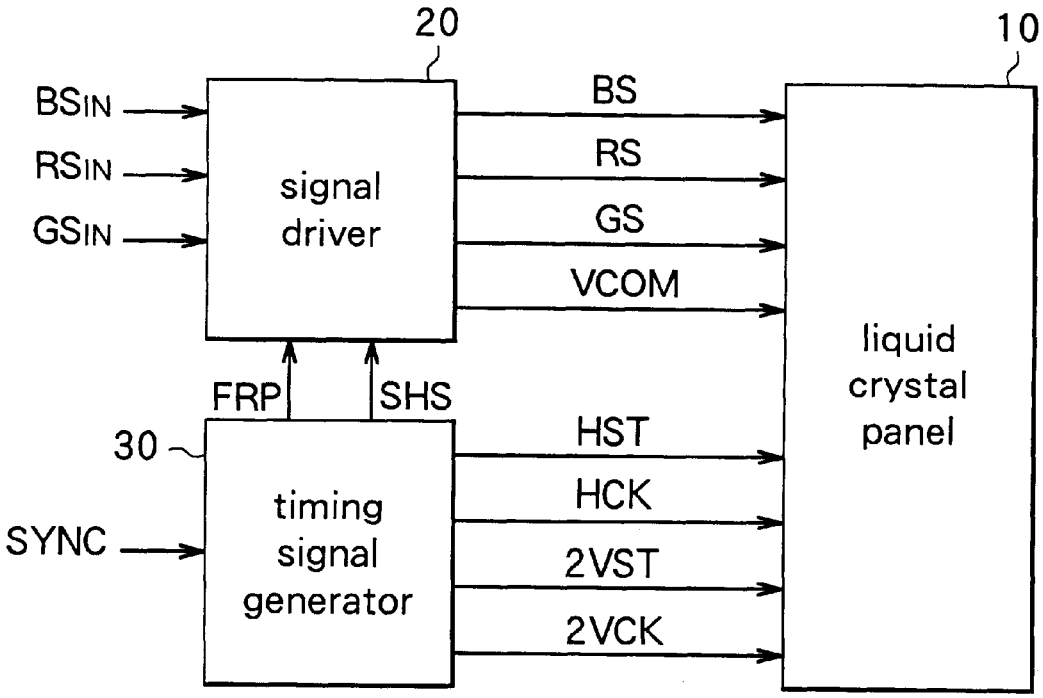
FIG. 1 is a block diagram showing the schematic structure of a color liquid crystal display device according to a first embodiment of the present invention.

FIG. 1 shows the schematic configuration of a color liquid crystal display device (hereinafter referred to simply as an "LCD device") according to a first embodiment of the present invention. This LCD device is driven by a so-called active matrix method. As shown in FIG. 1, the LCD device comprises a liquid crystal panel 10 constituting the principal portion of the present invention; a signal driver 20; and a timing signal generator 30. The liquid crystal panel 10 is equipped with a pel section 11 (shown in FIG. 2) to be described later. The signal driver 20 receives video input signals $BS_{IN}$, $RS_{IN}$, and $GS_{IN}$ and subjects these input signals to predetermined signal conversion to thereby output video signals BS, RS, and GS for driving red (R) pels, blue (B) pels, and green (G) pels (not all of the pels are shown in FIG. 1) in the liquid crystal panel 10. Further, the signal driver 20 is arranged so as to output a common potential signal VCOM to unillustrated opposing electrodes of the liquid crystal panel 10. The timing signal generator 30 produces timing signals HST, HCK, VST, VCK, FRP, and SHS from a synchronizing signal SYNC such as a composite synchronizing signal.

More specifically, the timing signal HST represents a start pulse for a horizontal shift register of the liquid crystal panel 10 (hereinafter referred to as an "H start pulse"), which will be described later. The timing signal HCK represents a clock pulse for driving the horizontal shift register (hereinafter referred to as an "H clock pulse"). The timing signal 2VST represents a start pulse for a vertical shift register of the liquid crystal panel 10 (hereinafter referred to as a "V start pulse"), which will be described later. The timing signal 2VCK represents a clock pulse for driving the vertical shift register (hereinafter referred to as a "V clock pulse"). The timing signal FRP represents a reverse/nonreverse select signal used when the signal driver 20 converts the video input signals $BS_{IN}$, $RS_{IN}$, and $GS_{IN}$ respectively into a.c. video signals BS, RS, and GS, all of which are centered on a certain d.c. voltage. The timing signal SHS represents a sample-and-hold signal used when the signal driver 20 sets the phase of each of the video signals BS, RS, and GS.

Figure 2:
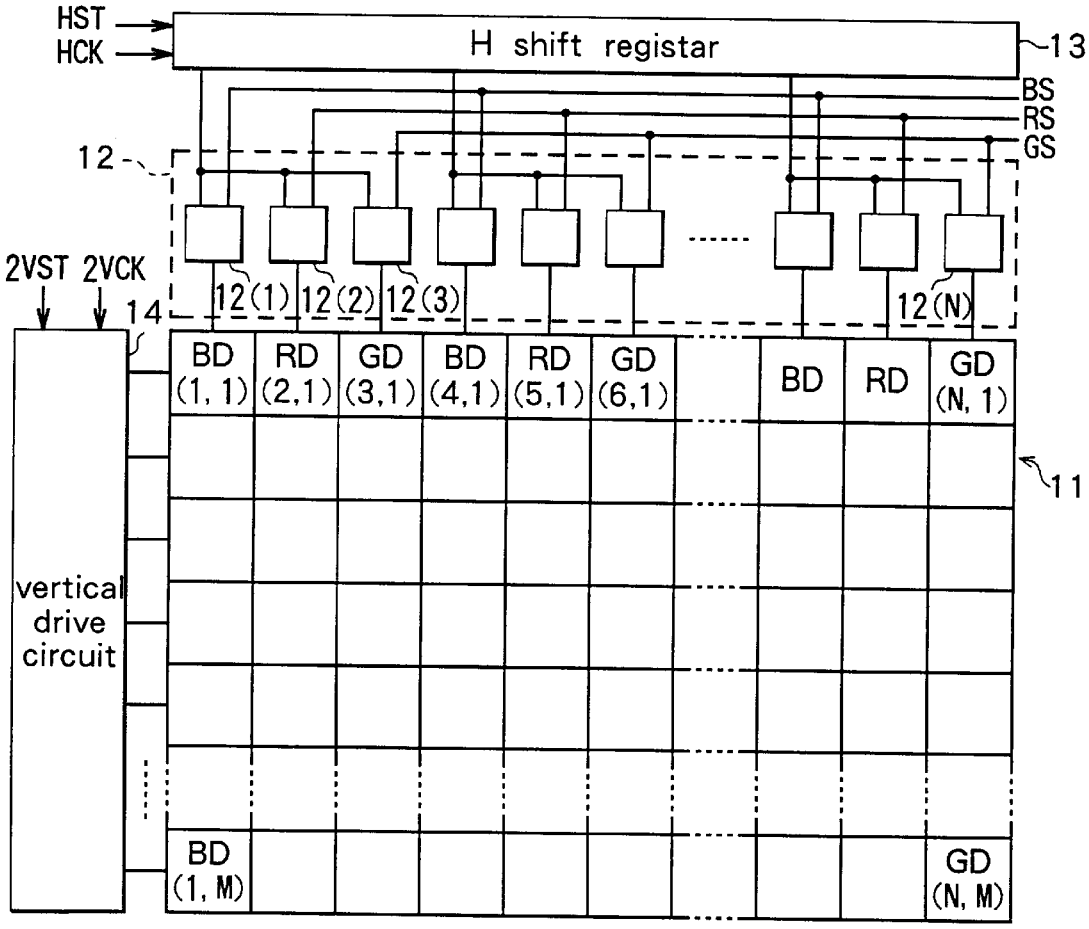
FIG. 2 represents the schematic structure of a liquid crystal panel shown in FIG. 1.

FIG. 2 shows one example of a configuration of the liquid crystal panel 10. As shown in FIG. 2, the liquid crystal panel 10 comprises a pel section 11; a horizontal drive circuit including a horizontal switch section 12 and a horizontal shift register 13 (hereinafter referred to simply as an "H shift register 13"); and a vertical drive circuit 14 including a vertical shift register 141 (hereinafter referred to simply as a "V shift register 141," not shown in FIG. 2). The H start pulse HST and the H clock pulse HCK shown in FIG. 1 enter the H shift register 13, and the V start pulse 2VST and the V clock pulse 2VCK shown in FIG. 1 enter the V shift register of the vertical driver circuit 14.

The pel section 11 is formed from pels, such as liquid crystal cells or switching elements, arranged into a matrix pattern. An image can be displayed by selectively driving the individual pels. For example, thin-film transistors (TFT) or the like are employed as the switching elements. In the example shown in FIG. 2, the pel section 11 comprises an N by M matrix of pels: namely, N pels BD(1,j), RD(2,j), GD(3,j), GD(N,j) . . . , GD(N,j) [j=1 to M] arranged in the horizontal direction, and M pels BD(1,l) to BD(1,M), RD(2, l) to RD(2,M), GD(3,l) to GD(3,M) . . . , GD(N,l) to GD(N,M) arranged in the vertical direction. Here, BD represents a blue pel; RD represents a red pel; and GD represents a green pel.

The horizontal switch section 12 comprises N horizontal switches 12(1) to 12(N) and has the function of selectively supplying the video signals BS, RS, and GS received from the signal driver 20 (shown in FIG. 1) to the pel section 11. The N horizontal switches 12(1) to 12(N) are divided into groups of three. Three switches of each group are connected commonly (or in shunt with one another) to individual transfer stages of the H shift register 13. A horizontal selection pulse signal is supplied sequentially to the individual groups at predetermined time intervals by way of the transfer stages of the H shift register 13. The predetermined time intervals are determined by the cycle of the H clock pulse HCK supplied to the H shift register 13 from the timing signal generator 30 (shown in FIG. 1). The three horizontal switches provided for each group are supplied with the video signals BS, RS, and GS from the timing signal generator 30 shown in FIG. 1.

The H shift register 13 comprises a plurality of pulse transfer stages and is capable of selecting a row of pels (i.e., a vertical row of pels) which are driven by the horizontal selection pulse sequentially output from the pulse transfer stages. More specifically, the H start pulse HST supplied from the timing signal generator 30 triggers operations of the H shift register 13. The H shift register 13 sequentially outputs the horizontal selection pulse from the individual transfer stages at the time intervals defined by the H clock pulse HCK, thereby performing horizontal pel selection scanning. The three horizontal switches provided in each group of the horizontal switch section 12 are simultaneously opened every time the horizontal selection pulse is supplied from the H shift register 13, thus feeding the video signals BS, RS, and GS, in shunt with one another, to the corresponding three vertical rows of pels in the pel section 11.

Figure 3:
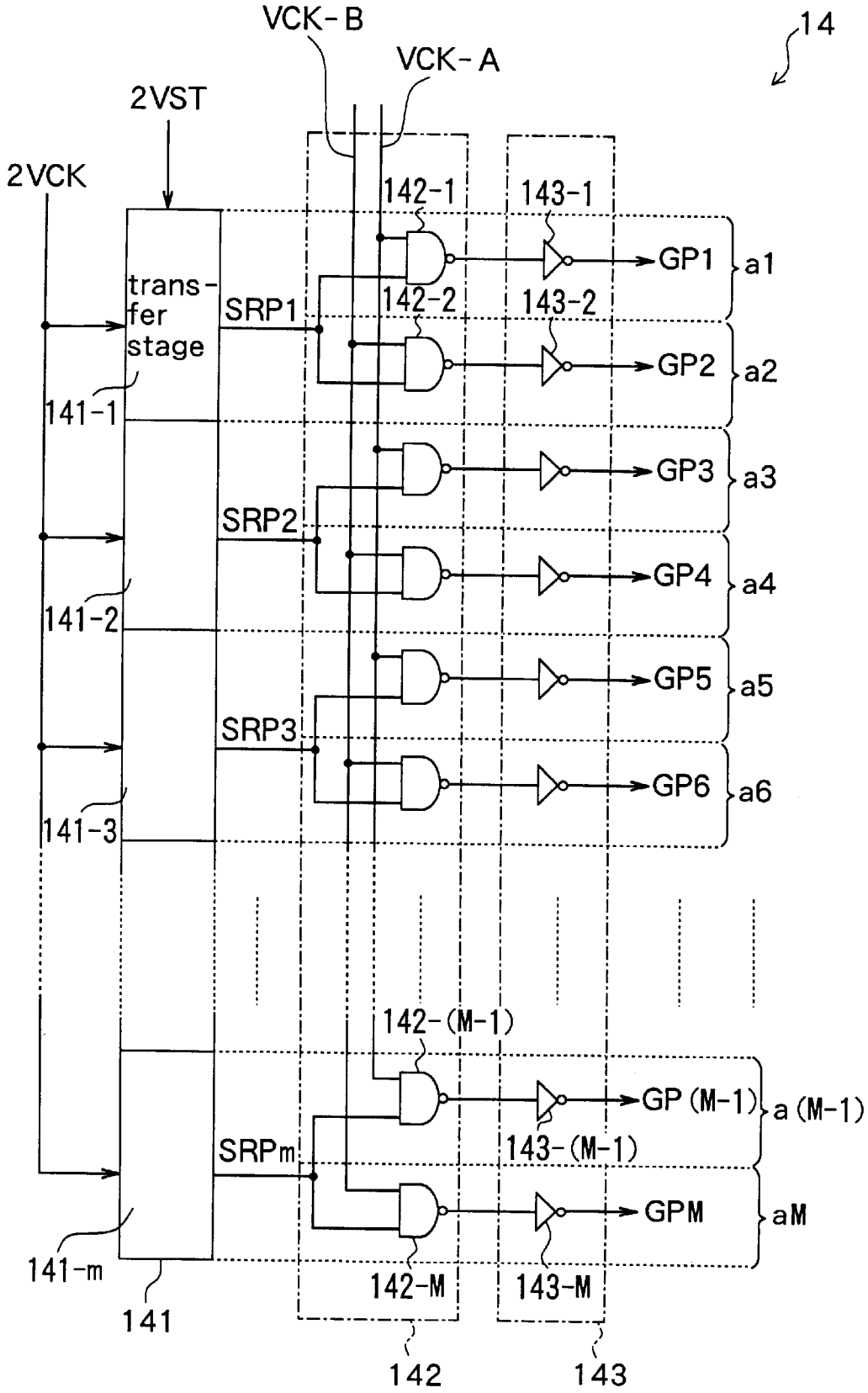
FIG. 3 is a circuit diagram showing the schematic configuration of a vertical drive circuit shown in FIG. 1.
Figure 4:
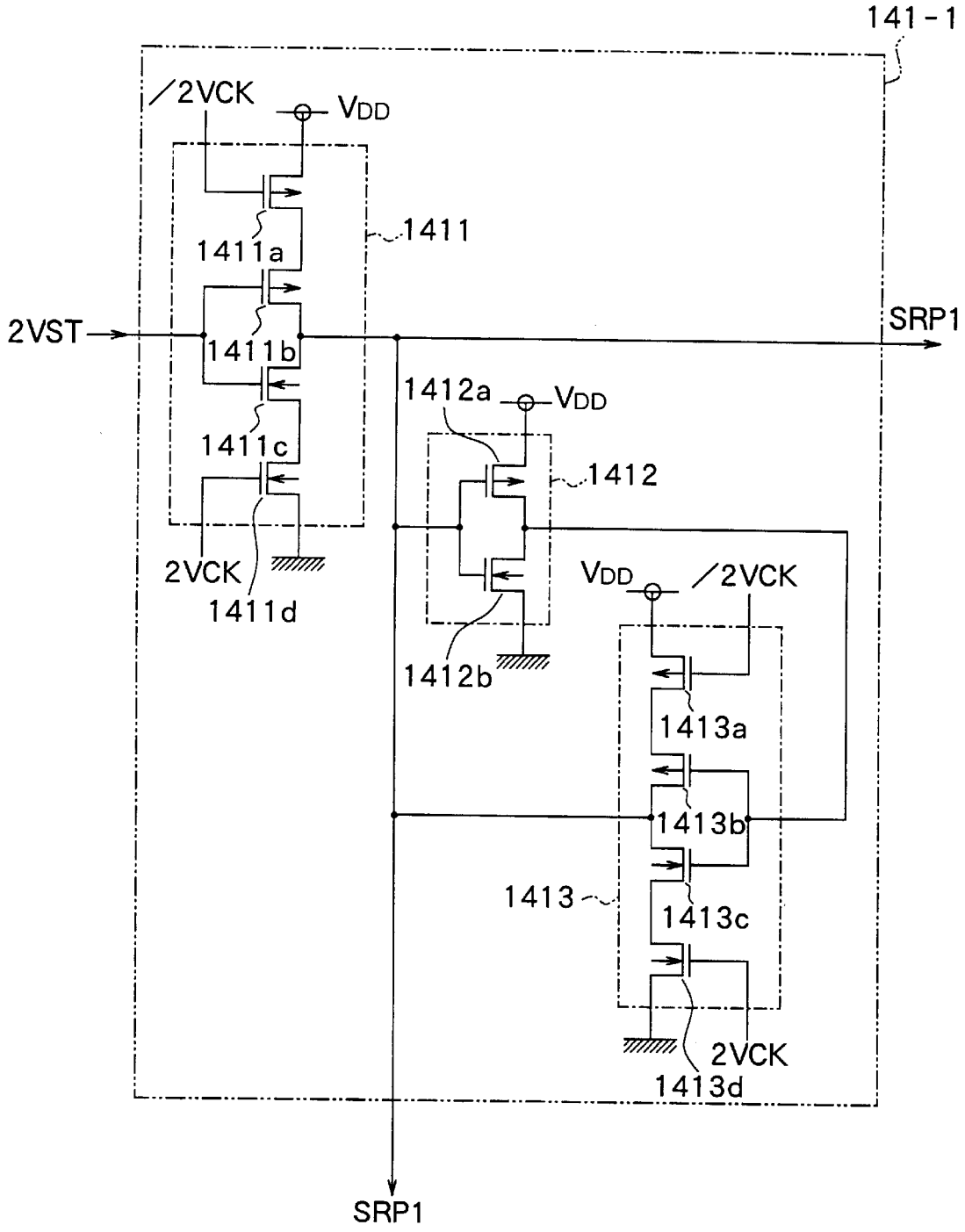
FIG. 4 is a circuit diagram showing the configuration of each transfer stage of a shift register shown in FIG. 3.
Figure 5:
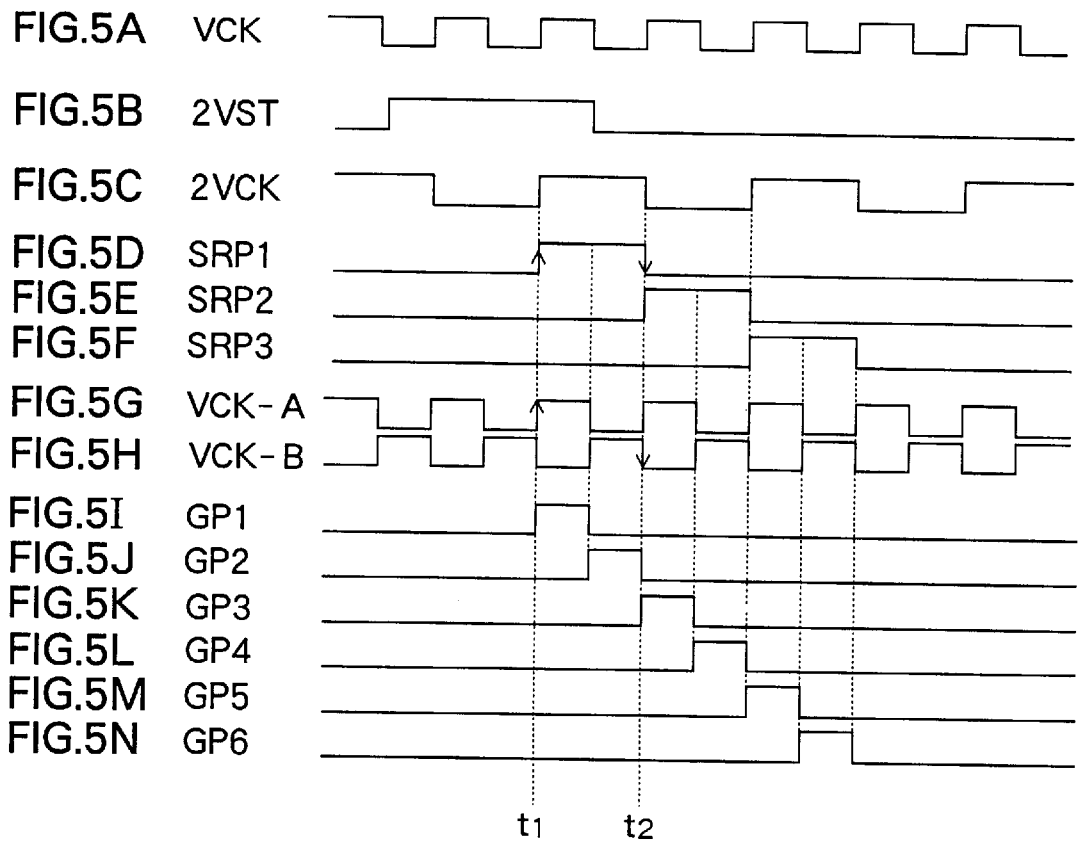
FIGS. 5A to 5N are timing charts for describing the operation of the vertical drive circuit shown in FIG. 3.

With reference to FIGS. 3 through 5, the configuration of the vertical drive circuit 14 will now be described. FIG. 3 shows the overall configuration of the vertical drive circuit 14; FIG. 4 shows the configuration of the V shift register 141 shown in FIG. 3; and FIGS. 5A to 5N show various signal waveforms appearing in the vertical drive circuit 14. As shown in FIG. 3, the vertical drive circuit 14 comprises the V shift register 141, a decoder 142, and a buffer 143.

The V shift register 141 comprises a plurality of pulse transfer stages 141-1 to 141-m. As will be described later, m=M/2. A pulse transfer stage 141-1 provided at the leading end is supplied with a V start pulse 2VST as shown in FIG. 5B from the timing signal generator 30 shown in FIG. 1. The pulse transfer stages 141-1 to 141-m are also supplied with a V clock pulse 2VCK as shown in FIG. 5C from the timing signal generator 30. As will be described later, each of the pulse transfer stages 141-1 to 141-m comprises one inverter and two clocked inverters which operate synchronously with the V clock pulse VCK, wherein the inverter and the two clocked inverters are connected in series. As shown in FIG. 3, one pulse transfer stage is provided so as to correspond to two pel lines of the pel section 11 (shown in FIG. 2). More specifically, the pulse transfer stage 141-1 corresponds to pel lines a1 and a2; the pulse transfer stage 141-2 corresponds to pel lines a3 and a4; and the pulse transfer stage 141-m corresponds to pel lines a(M−1) and aM. For instance, a pel line $a_j$ (j=1 to M) represents a horizontal row of pels BD(1,j) to GD(N,j) in the pel section 11. The V start pulse 2VST supplied from the timing signal generator 30 triggers the V shift register 141 having such a configuration to start transferring a pulse among the transfer stages; namely, sequentially outputting shift register pulses SRP1 to SRPm as shown in FIGS. 5D to 5F (only SRP1 to SRP3 of these shift register pulses are provided in FIGS. 5D to 5F) received from the pulse transfer stages 141-1 to 141-m, at the time intervals determined by the V clock pulse 2VCK. The V shift register 141 corresponds to the "pulse shift means" according to the present invention, and the shift register pulses SRP1 to SRPm correspond to "first pulse signals" according to the present invention.

As shown in FIG. 4, the pulse transfer means 141-1 of the V shift register 141 comprises a clocked inverter 1411, and a latch circuit including an inverter 1412 and a clocked inverter 1413, both of which are connected to the output terminal of the clocked inverter 1411.

The clocked inverter 1411 comprises two PMOS transistors 1411*a* and 1411*b* and two NMOS transistors 1411*c* and 1411*d*. The source/drains of the transistors 1411*a* and 1411*b* are interconnected together, and the source/drains of the transistors 1411*c* and 1411*d* are also interconnected together. The transistors 1411*b* and 1411*c* constitute a CMOS structure, and the V start pulse 2VST is input to the gate of the transistor 1411*b* and that of the transistor 1411*c*. The drains of the transistors 1411*b* and 1411*c* are interconnected together and are connected as an output terminal to the input terminal of the pulse transfer stage in the next stage (i.e., the gates of transistors 1411*b* and 1411*c* of the pulse transfer stage 141-2). The source of the transistor 1411*a* is connected to the power line $V_{DD}$, and the source of the transistor 1411*d* is grounded. A signal /2VCK which is the inverse of the V clock pulse 2VCK is input to the gate of the transistor 1411*a*. The V clock pulse 2VCK is input to the gate of the transistor 1411*d*.

The inverter 1412 comprises CMOS transistors 1412*a* and 1412*b*. The input terminal of the inverter 1412 (i.e., the gates of the transistors 1412*a* and 1412*b*) is connected to the output terminal of the clocked inverter 1411 (i.e., the drains of the transistors 1411*b* and 1411*c*). The source of the transistor 1412*a* is connected to the power line $V_{DD}$, and the source of the transistor 1412*b* is grounded.

The clocked inverter 1413 is identical in structure to the clocked inverter 1411. Specifically, the clocked inverter 1413 comprises two PMOS transistors 1413*a* and 1413*b* and two NMOS transistors 1413*c* and 1413*d*. The input terminal of the clocked inverter 1413 (i.e., the gates of the transistors 1412*a* and 1412*b* that constitute a CMOS structure) is connected to the output terminal of the inverter 1412 (i.e., the drains of the transistors 1412*a* and 1412*b*). The output terminal of the clocked inverter 1413 (i.e., the drains of the transistors 1413*b* and 1413*c*) is connected to the input terminal of the inverter 1412 (i.e., the gates of the transistors 1412*a* and 1412*b*).

In the pulse transfer stage 141-1 having the foregoing configuration, the shift register pulse SRP1 is output from the output terminal of the clocked inverter 1411 (i.e., the drains of the transistors 1411*b* and 1411*c*). The thus-output pulse SRP1 is input to the decoder 142 as well as transferred to the next pulse transfer means 141-2. The same applies to the remaining pulse transfer stages 141-2 to 141-m.

Turning again back to FIG. 3, the decoder 142 comprises NAND gates 142-j (j=1 to M), one NAND gate provided for each pel line $a_j$ of the pel section 11. A decode pulse VCK-A as shown in FIG. 5G is input to either of the input terminals of each of the odd-numbered NAND gates 142-1, 142-3, . . . [hereinafter referred to as "142-(2*k*−1)"]. A decode pulse VCK-B as shown in FIG. 5H is input to either of the input terminals of each of the even-numbered NAND gates 142-2, 142-4, . . . (hereinafter referred to as "142-2*k*"). Here, the decode pulse VCK-A has a cycle which is half the V clock pulse 2VCK, and the decode pulse VCK-B has a waveform which is the inverse of the waveform of the decode pulse VCK-A.

A shift register SRPk output from a pulse transfer stage 141-k of the V shift register 142 is input to the other one of the input terminals of each of the NAND gates 142-(2k−1) and 142-2k of the decoder 142 (where k=1 to m). The NAND gates 142-(2k−1) decode the shift register pulse SRPk through use of the decode pulse VCK-A and output a resultant decoded signal, whereas the NAND gates 142-2k decode the shift register pulse SRPk through use of the decoder pulse VCK-B and output a resultant decoded signal. The decoder 142 corresponds to an example of the "drive pulse generation means" according to the present invention.

The buffer 143 includes buffers 143-j (j=1 to M), one buffer provided for each pel line $a_j$ of the pel section 11. The input terminal of each buffer 143-j is connected to the output terminal of the corresponding NAND gate 142-j of the decoder 142, and the output terminal of each buffer 143-j is connected to the gate of a corresponding TFT (not shown) constituting the pel of each pel line $a_j$. The buffer 143-j reverses the logic value of a signal output from a corresponding NAND gate 142-j, thereby outputting a gate pulse GPj corresponding to any one of those shown in FIGS. 5I to 5N. The gate pulse GPj is supplied to the gate (not shown) of the TFT constituting each of the pels in a corresponding pel line $a_j$ in the pel section 11, thereby driving the pel. The buffer 143-j also has the capability of separating the decoder 142 and the V shift register 141 from their corresponding pel line $a_j$ of the pel section 11 in order to prevent the decoder 142 and the V shift register 141 from being affected by the line capacitance of the corresponding pel line $a_j$. The gate pulse GPj corresponds to the "second pulse signal."

The operation of the color LCD device having the structure set forth will now be described.

In FIG. 3, the V start pulse 2VST output from the timing signal generator 30 (shown in FIG. 1) is input to the pulse transfer stage 141-1 of the V shift register 141. The V clock pulse 2VCK is supplied to the individual pulse transfer stages 141-1 to 141-m. These pulse transfer stages 141-1 to 141-m sequentially perform pulse transfer operations according to the V clock pulse 2VCK, and as well sequentially output the shift register pulses SRP1 to SRPm such as those shown in FIGS. 5D to 5F.

The shift register pulses SRP1 to SRPm output from the corresponding pulse transfer stages 141-1 to 141-m of the V shift register 141 are input to the corresponding NAND gates of the decoder 142. Specifically, the shift register pulse SRPk (k=1 to m) is input to the corresponding NAND gates 142-(2k−1) and 142-2k. The NAND gate 142-(2k−1) decodes the shift register pulse SRPk through use of the decode pulse VCK-A as shown in FIG. 5G and outputs a decoded signal, whereas the NAND gate 142-2k decodes the shift register pulse SRPk through use of the decode pulse VCK-B as shown in FIG. 5H and outputs a decoded signal. The output from the NAND gates 142-j (j=1 to M) is inverted by the buffer 143-j of the buffer section 143, and one of the gate pulses GPj as shown in FIGS. 5I to 5N is output. The gate pulse GPj is supplied to the gates of the TFTs of the corresponding pel line $a_j$ in the pel section 11 (shown in FIG. 2), thereby activating the transistors.

The H start pulse HST and the H clock pulse HCK output from the timing signal generator 30 (shown in FIG. 1) are supplied to the H shift register 13 (shown in FIG. 2). The H shift register 13 outputs the horizontal selection pulse while sequentially shifting the same according to the H start pulse HST and the H clock pulse HCK. The horizontal selection pulse is sequentially input to the individual horizontal switch groups in the horizontal switch section 12, thereby bringing the horizontal switches in each group into an open state. As a result, the pel lines from the first row to the $N^{th}$ row are sequentially selected in blocks of three.

During a period of time over which the pel line a1 is selected by the gate pulse GP1 output from the buffer section 143, when the first through third pel lines are selected by the horizontal selection pulse output from the H shift register 13, the video signals BS, RS, and GS output from the signal driver 20 are supplied to the pels BD(1,1), RD(2,1), and GD(3,1) of the pel line a1. Next, the fourth to sixth pel lines are selected, where by the video signals BS, RS, and GS are supplied to pels BD(4,1), RD(5,1), and GS(6,1). Similarly, the pels on the pel line a1 are sequentially selected in groups of three, and the video signals BS, RS, and GS are simultaneously supplied to the thus-selected three pels.

After completion of writing of the video signals to the N pels in the pel line a1, a pel line a2 is selected by a gate pulse GP2. As in the case with the pel line a1, pels are selected in groups of three, and the video signals BS, RS, and GS are simultaneously supplied to the thus-selected three pels. Similarly, every time the supply of the video signals for one pel line has been finished, the next pel line is selected by the gate pulse GPj, thus completing writing of the video signals corresponding to one field. After completion of writing of the video signals corresponding to one field, identical operations are performed for the next field.

An example to be compared with the first embodiment will now be described by reference to FIGS. 6 and FIGS. 7A to 7N.

Figure 6:
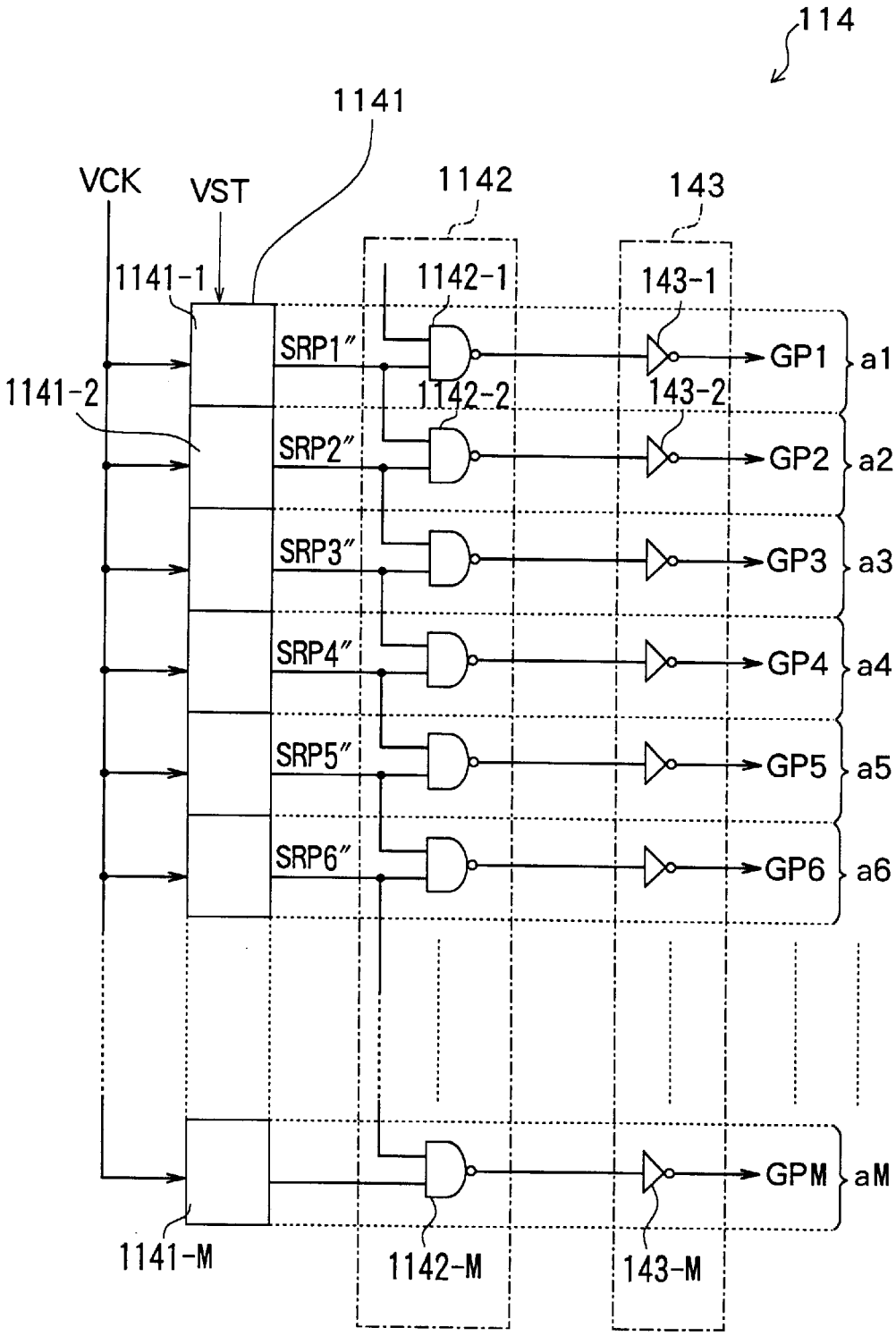
FIG. 6 is a circuit diagram showing the schematic configuration of a vertical drive circuit for comparison with the vertical drive circuit according to the first embodiment.
Figure 7:
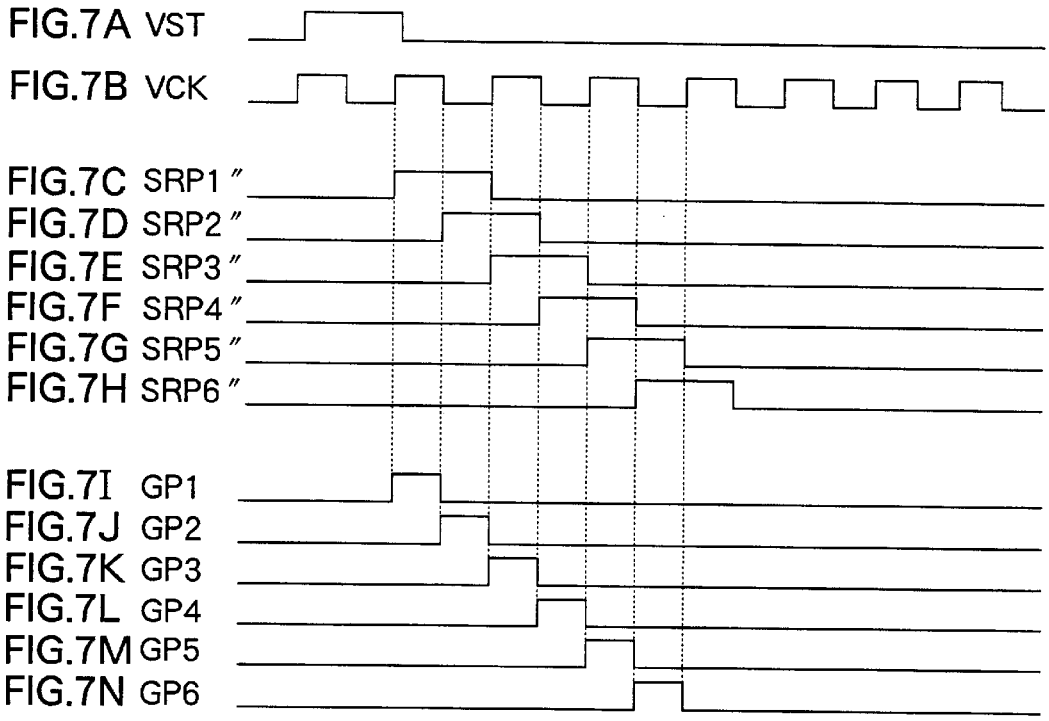
FIGS. 7A to 7N are timing charts for describing the operation of the vertical drive circuit shown in FIG. 6.

FIG. 6 represents a schematic configuration of a vertical drive circuit 114 of a first comparative example (for comparison with the vertical drive circuit 14 according to the first embodiment). FIGS. 7A to 7N are timing charts showing various signals appearing in the vertical drive circuit 114. In these drawings, elements that are identical with those shown in the first embodiment (i.e., those shown in FIG. 3 and FIGS. 5A to 5N) are assigned the same reference numerals. As shown in FIG. 6, the vertical drive circuit 114 according to the first comparative example comprises a V shift register 1141, a decoder 1142, and a buffer section 143. In contrast with the V shift register 141 according to the first embodiment, the V shift register 1141 of the first comparative example comprises a total amount of M (=2m) pulse transfer stages 1141-j (j=1 to M) provided so as to correspond to each pel line $a_j$ of the pel section 11. Here, the pulse transfer stage 1141-j is identical in circuit configuration to each of the pulse transfer stages 141-1 to 141-m according to the first embodiment shown in FIG. 4. Specifically, the pulse transfer stage 1141-j comprises two clocked inverters and one inverter. A V start pulse VST as shown in FIG. 7A and a V clock pulse VCK as shown in FIG. 7B are input to the V shift register 1141. The frequency of the V start pulse VST is double that of the V start pulse 2VST according to the first embodiment (or the V start pulse VST has half the cycle of the V start pulse 2VST), and the frequency of the V clock pulse VCK is double that of the V clock pulse 2VCK (or the V clock pulse VCK).

The pulse transfer stage 1141-j of the V shift register 1141 performs a pulse transfer operation according to the V start pulse VST and the V clock pulse VCK, thereby sequentially outputting a shift register pulse SRPj" like one of those shown in FIGS. 7C to 7H (only SPR1" to SPR6" are illustrated in the drawing). The shift register pulse SRPj" is supplied to a corresponding NAND gate 1142-j in the decoder 1142. The NAND gate 1142-j in the decoder 1142 decodes the shift register pulse SRPj" received from the corresponding pulse transfer stage 1141-j, through use of a shift register pulse SRP(j−1)" received from the preceding pulse transfer stage 1141-(j−1), and outputs a decoded signal. A buffer 143-j of the buffer section 143 reverses the logic value of a signal output from the corresponding NAND gate 1142j and outputs to the corresponding pel line $a_j$ the gate pulse GPj corresponding to any one of those shown in FIGS. 7I to 7N.

In the vertical drive circuit 114 according to the first comparative example, the pulse transfer stage 1141-j of the V shift register 1141 is provided so as to correspond to the pel line $a_j$ of the pel section 11 in a one-to-one relationship. As shown in FIG. 4, the single pulse transfer stage 1141-j requires a total amount of ten transistor elements, and complicated wiring is required for interconnecting the transistor elements. In consideration of these requirements, a single pulse transfer stage 1141-j requires a considerable area. If reducing pel pitch is attempted so as to realize high definition in the pel section 11, forming one pulse transfer stage 1141-j in the area corresponding to the width of one pel line $a_j$ becomes difficult. For example, when one transfer stage of the V shift register 1141 is formed so as to assume the circuit configuration shown in FIG. 4, ten transistor elements must be provided in the area corresponding to the width of one pel line, thereby hindering a reduction in pel pitch. Even if one pulse transfer stage 1141-j may be formed in the area corresponding to the width of one pel line $a_j$ through miniaturization of a transistor element and a wiring pattern in association with improvement in manufacturing technology, realizing formation of such a color LCD device without involvement of an increase in manufacturing costs would be difficult. Further, in the event of an increase in the number of pel lines $a_j$ (=M) in the pel section 11, the number of elements required for constituting the V shift register 1141 would also increase proportionally, thus inevitably resulting in a remarkable rise in the amount of electric current dissipated by the vertical drive circuit 114. As shown in FIGS. 7A and 7B, the V start pulse VST and the V clock pulse VCK used for activating the V shift register 1141 are both of high frequency. Hence, transistor elements which constitute the individual pulse transfer stages of the V shift register 1141 must assume superior frequency responses. Even in this regard, the LCD device according to the comparative example suffers a problem related to structure.

In the vertical drive circuit 14 according to the first embodiment, one pulse transfer stage is provided for two pel lines, and the decoder 142 decodes a signal output from each pulse transfer stage, thereby preparing the gate pulse GPj for each pel line $a_j$. For a given number of pel lines, the number of pulse transfer stages of the V shift register 141 can be diminished to half those of the V shift register 141 according to the first comparative example. Consequently, the total number of elements required for constituting the V shift register 141 can be diminished to about one-half that employed in the first comparative example, and the consumed current can be reduced. Further, since a single transfer stage can be formed in the area corresponding to two pel lines, even the current level of manufacturing technology can sufficiently cope with a reduction in pel pitch. For example, in a case where one transfer stage of the V shift register 141 is formed so as to assume the configuration shown in FIG. 4, ten transistor elements formed from, e.g., TFTs, are required to be formed in the area corresponding to two pel lines. Only five transistor elements are formed per pel line, thereby rendering manufacture of the LCD device easy. The V start pulse 2VST and V clock pulse 2VCK (shown in FIGS. 5B and 5C) used for activating the V shift register 141 are lower in frequency than the V start pulse VST and the V clock pulse VCK (shown in FIGS. 7A and 7B). Transistor elements which constitute each pulse transfer stage of the V shift register 141 are not required to possess superior frequency response, and transistor elements possessing ordinary frequency response may be used.

Figure 8:
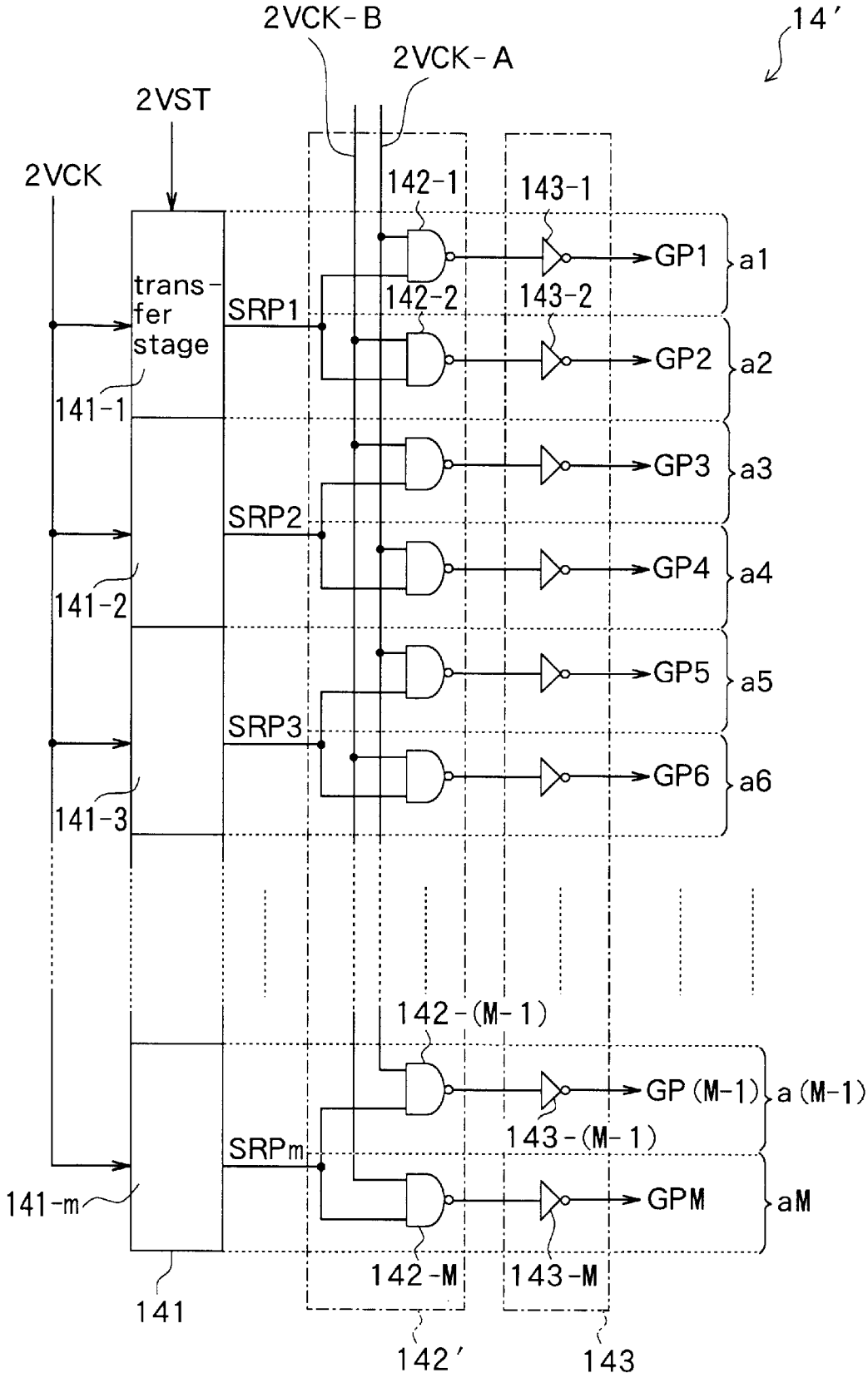
FIG. 8 is a circuit diagram showing a modification of the vertical drive circuit shown in FIG. 3.
Figure 9:
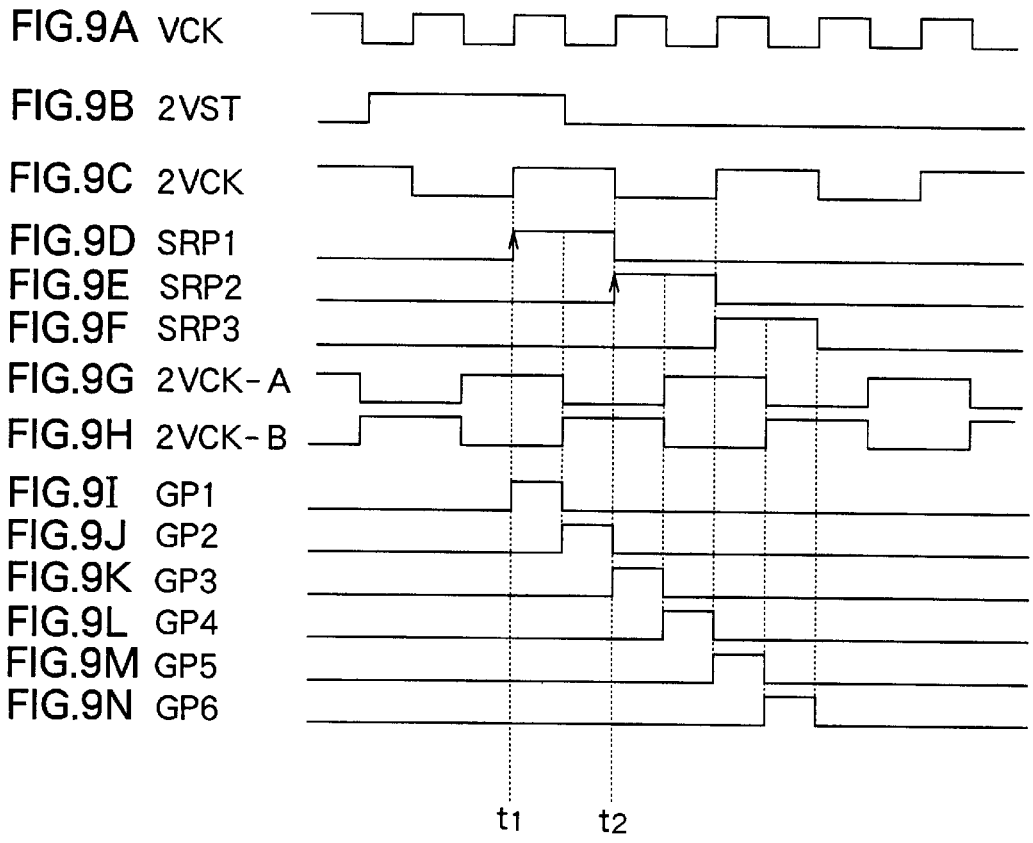
FIGS. 9A to 9N are timing charts for describing the operation of the vertical drive circuit shown in FIG. 8.

As shown in FIG. 3, in the first embodiment, the decode pulses VCK-A and VCK-B used in the decoder 142 are input in such a way as to be alternately assigned to the NAND gates in sequence of VCK-A, VCK-B, VCK-A, VCK-B, . . . Alternatively, as shown in FIG. 8 and FIGS. 9A to 9N, the method of assigning the decode pulses may be modified; such that there may be prepared a decode pulse 2VCK-A which has twice the pulse width of the decode pulse VCK-A (i.e., the frequency of the decode pulse 2VCK-A is one-half that of the decode pulse VCK-A) and a decode pulse 2VCK-B which has twice the pulse width of the decode pulse VCK-B (i.e., the frequency of the decode pulse 2VCK-B is one-half that of the decode pulse VCK-B). These decode pulses may be assigned NAND gates of a decoder 142' in sequence of 2VCK-A, 2VCK-B, 2VCK-B, 2VCK-A, . . . FIG. 8 shows the schematic configuration of the vertical drive circuit 14', which is a modification of the first embodiment, and FIGS. 9A to 9N are timing charts showing various signals appearing in the vertical drive circuit 14' shown in FIG. 8. In these drawings, elements that are identical with those shown in FIG. 3 and FIGS. 5A to 5N are assigned the same reference numerals, and repetition of their explanations is omitted. FIG. 8 and FIGS. 9A to 9N are the same as FIG. 3 and FIGS. 5A to 5N, except for the waveform of the decode pulses 2VCK-A and 2VCK-B and a method of assigning the decode pulses 2VCK-A and 2VCK-B to the individual NAND gates.

In the modification shown in FIG. 8, the frequency of the decode pulses 2VCK-A and 2VCK-B (shown in FIGS. 9G and 9H) can be reduced to half that of the decode pulses VCK-A and VCK-B (shown in FIGS. 5G and 5H). Accordingly, transistor elements constituting the NAND gates are not required to possess superior frequency responses. In the first embodiment shown in FIG. 5, at timings t1 and t2, for example, the shift register pulse SRP1 and the decode pulse VCK-A or VCK-B simultaneously rise or fall. If a minute timing error exists between these pulses, whisker-like spike noise may arise in the output from the NAND gate. In contrast, in the modification shown in FIG. 8, the shift register pulse SRP1 and the decode pulse 2VCK-A or 2VCK-B rise and fall at completely different timings, thereby eliminating the possibility of the whisker-like spike noise arising.

[Second Embodiment]

A second embodiment of the present invention will now be described.

Figure 10:
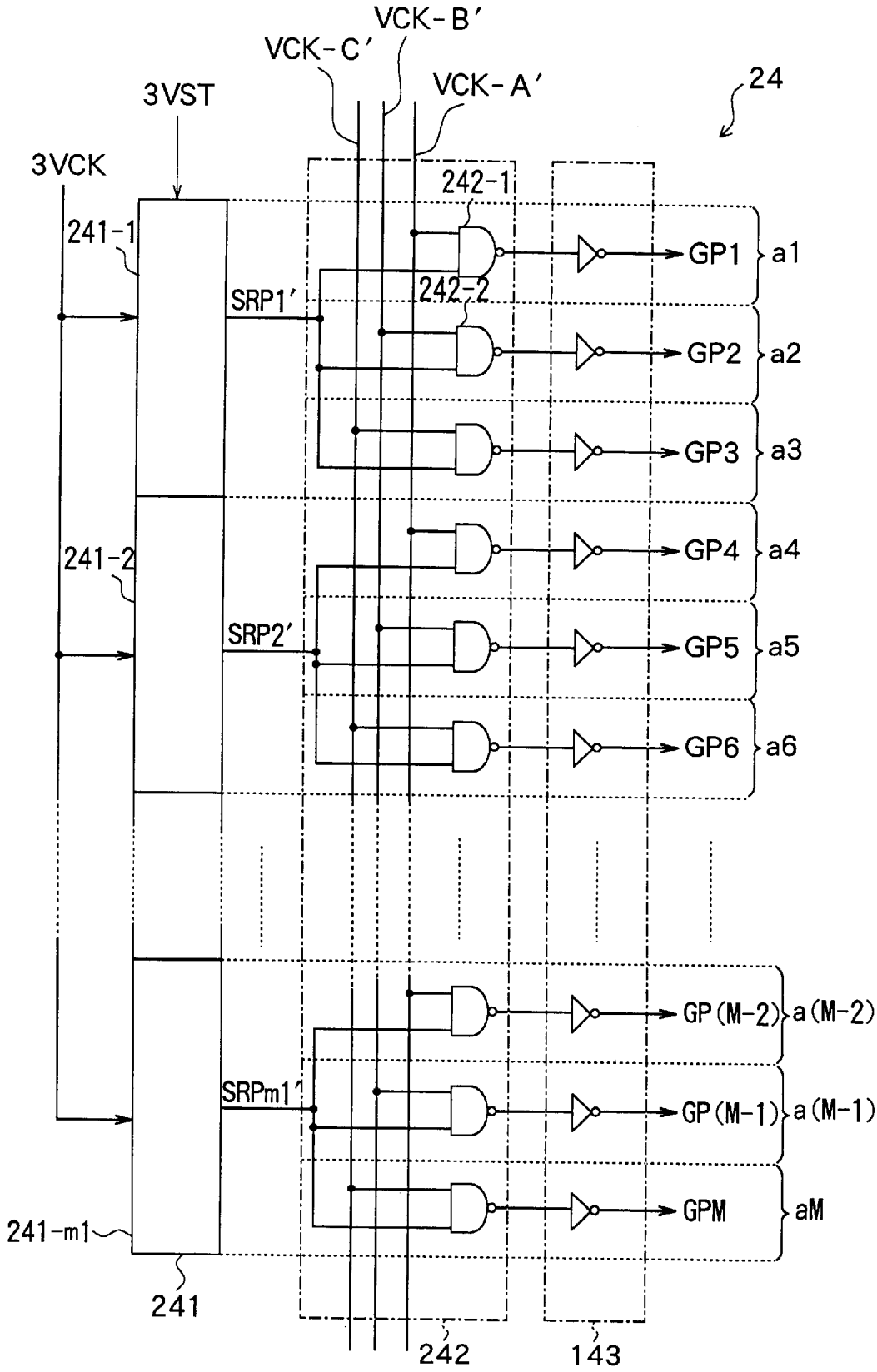
FIG. 10 is a block diagram showing the schematic configuration of a vertical drive circuit for use in a color liquid crystal display device according to a second embodiment of the present invention.
Figure 11:
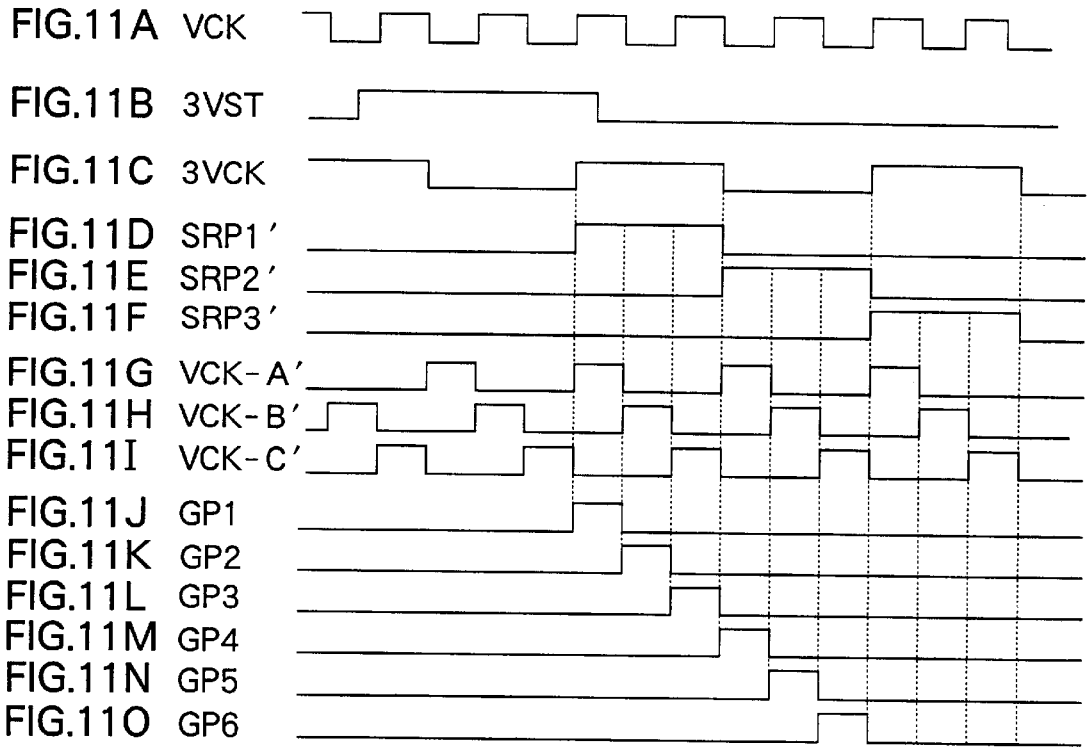
FIGS. 11A to 11O are timing charts for describing the operation of the vertical drive circuit shown in FIG. 10.

FIG. 10 shows the schematic configuration of the vertical drive circuit 24 applied to a color LCD device according to the second embodiment. The vertical drive circuit 24 is provided with a V shift register 241 and a decoder 242 in lieu of the V shift register 141 and the decoder 142 according to the first embodiment (shown in FIG. 3). The V shift register 241 comprises ml pulse stages from 241-1 to 241-ml. Each pulse transfer means 241-p (where p=1 to ml) is provided for three pel lines a(3p−2), a(3p−1), and a(3p) of the pel section 11 (shown in FIG. 2) and has the same internal configuration as that shown in FIG. 4. Here, ml=M/3 (M=a natural number). The V shift register 241 receives from the timing signal generator 30 (shown in FIG. 1) a V start pulse 3VST (FIG. 11B) whose cycle is three times that of the V start pulse VST (FIG. 7A) according to the first comparative example, and a V clock pulse 3VCK (FIG. 1C) whose cycle is three times that of the V clock pulse VCK (FIG. 7B) according to the same. The V shift register 241 corresponds to an example of the "pulse shift means" according to the present invention.

The decoder 242 is supplied with three decode pulses VCK-A' (FIG. 11G), VCK-B' (FIG. 11H), and VCK-C' (FIG. 11I) which are out of phase with one another. Specifically, the decode pulse VCK-A' is input to either of two input terminals of a NAND gate 242-(3p−2); the decode pulse VCK-B' is input to either of two input terminals of a NAND gate 242-(3p−1); and the decode pulse VCK-C' is input to either of two input terminals of a NAND gate 242-3p. The remaining input terminal of each of the NAND gates 242-(3p−2), 242-(3p−1), and 242(3p) is supplied with a shift register pulse SRPp from the pulse transfer stage 241-p of the V shift register 241. The decoder 242 corresponds to an example of the "drive pulse generation means" according to the present invention, and the shift register pulse SRPp corresponds to an example of the "first pulse signal" according to the present invention.

The operation of the vertical drive circuit 24 having the foregoing configuration will now be described. The V start pulse 3VST output from the timing signal generator 30 is input to the pulse transfer stage 241-1 of the V shift register 241, and the V clock pulse 3VCK output from the same is supplied to the pulse transfer stages 241-1 to 241-ml of the V shift register 241. According to the V clock pulse 3VCK, the pulse transfer stages 241-1 to 241-ml sequentially shift a pulse and output shift register pulses SRP1' to SRPml' (FIGS. 11D to 11F) in sequence. The shift register pulses SRP1' to SRPml' are input to corresponding NAND gate sets (each set comprising three NAND gates). More specifically, the shift register pulse SRPp is input to the three NAND gates 242-(3p−2), 242-(3p−1), and 242-3p (where p=1 to ml). The NAND gate 242-(3p−2) decodes the shift register pulse SRPP through use of the decode pulse VCK-A' and outputs a decoded signal; the NAND gate 242-(3p−1) decodes the shift register pulse SRPP through use of the decode pulse VCK-B' and outputs a decoded signal; and the NAND gate 242-3p decodes the shift register pulse SRPp through use of the decode pulse VCK-C' and outputs a decoded signal. The logic value of the signal output from each of the NAND gates is reversed by the buffer 143-j of the buffer section 143, and the inverted signal is output as a gate pulse GPj corresponding to any one of the pulses shown in FIGS. 11J to 11O. The gate pulse GPj is supplied to the gate of a TFT of each pel in the corresponding pel line $a_j$ in the pel section 11 (FIG. 2), thereby turning on the transistor.

As mentioned above, according to the second embodiment, one pulse transfer stage 241-p is provided for three pel lines in the pel section 11, thereby enabling a further reduction in the total number of elements required for constituting the V shift register 241 relative to the first embodiment. Consequently, the amount of electric current to be dissipated can be diminished to a much greater extent. One pulse transfer stage is formed within an area corresponding to the width of three pel lines. Even if pel pitch is diminished further, current manufacturing technology can sufficiently cope with such miniaturization. For example, in a case where one transfer stage of the V shift register 241 is formed so as to assume a configuration as shown in FIG. 4, ten transistor elements are formed within the area corresponding to the width of three pel lines. About three transistors are formed per pel line, thereby further facilitating manufacture of the drive circuit. The V start pulse 3VST (FIG. 11B) and the V clock pulse 3VCK (FIG. 11C) used for activating the V shift register 241 are lower in frequency than the V start pulse 2VST and the V clock pulse 2VCK according to the first embodiment. Accordingly, the frequency responses required for the transistor elements constituting each of the pulse transfer stages of the V shift register 241 become less rigorous.

[Third Embodiment]

A third embodiment of the present invention will now be described.

Figure 12:
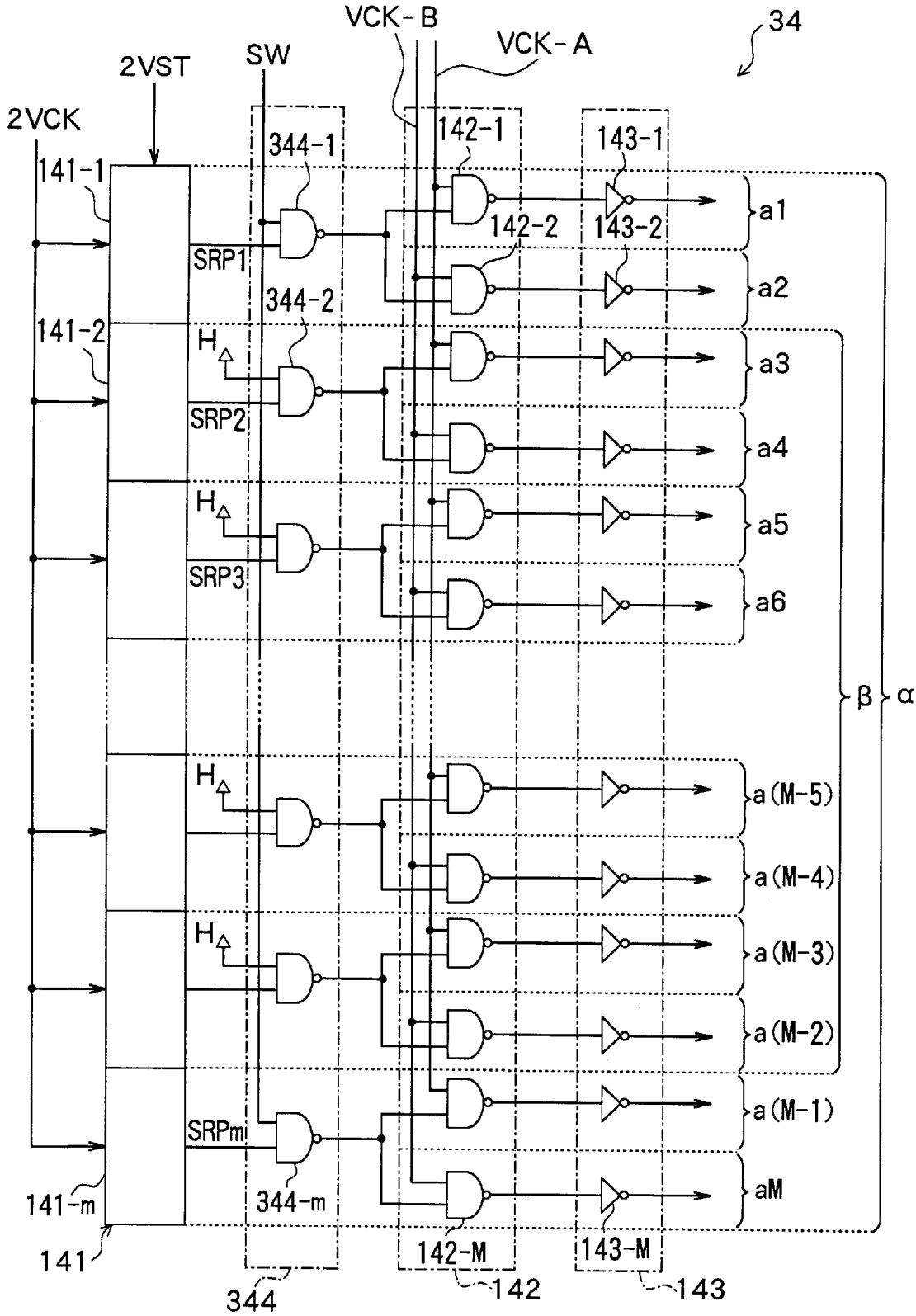
FIG. 12 is a block diagram showing the schematic configuration of a vertical drive circuit for use with a color liquid crystal display device according to a third embodiment of the present invention.

FIG. 12 shows the schematic structure of a vertical drive circuit 34 applied to a color LCD display according to the third embodiment. The vertical drive circuit 34 corresponds to a configuration in which a display changeover circuit 344 is provided between the V shift register 141 and the decoder 142 within the vertical driver circuit 14 (FIG. 3) according to the first embodiment. This display changeover circuit 344 is capable of switching between a display area α and another display area β of the pel section 11 (FIG. 2) according to the type (standard) of an input video signal. Here, the display area a allows display of all the pel lines a1 to aM of the pel section 11, and the display area β allows display of pel lines a2 to a(M−1) of the pel section 11.

As shown in FIG. 12, the display changeover circuit 344 comprises m-NAND gates 344-1 to 344-m (where m=M/2). Each NAND gate 344-k (where k=1 to m) is intended to control whether the shift register pulse SRPk output from the pulse transfer stage 141-k of the V shift register 141 is input to the corresponding NAND gate 142-(2k−1) or to the corresponding NAND gate 142-2k of the decoder 142 on the subsequent stage. A shift register pulse SRPk is input to either of two input terminals of a NAND gate 344-k. A display changeover signal SW which assumes either a high- or low-level value is input to the remaining input terminal of each of the NAND gates from 344-1 (on the top stage) to 344-m (on the bottom stage). The remaining input terminal of each of the remaining NAND gates 344-2 to 344-(m−1) is fixed to a high level. In other respects, the vertical drive circuit 34 is identical in structure with the vertical drive circuit 34 (FIG. 3). Here, the display changeover circuit 344 corresponds to an example of the "changeover means" according to the present invention.

The operation of the vertical drive circuit 34 having such a configuration will now be described.

To make the display area a active, the display changeover signal SW input to the NAND gates 344-1 to 344-m of the display changeover circuit 344 is brought to a high state, thereby opening each of the NAND gates 344-1 to 344-m.

All the shift register pulses SRP-1 to SRPm output from the V shift register 141 are supplied to the decoder 142, exactly as they are. In other words, in this state, the vertical drive circuit 34 becomes equivalent to that shown in FIG. 3. The display area α corresponding to the entirety of the pel section 11 becomes active, and an image is displayed in the display area α.

In contrast, to make the display area β active, the display changeover signal SW input to the NAND gates 344-1 to 344-m of the display changeover circuit 344 is brought to a low state. As a result, each of the NAND gates 344-2 to 344-(m−1) becomes open, and each of the NAND gates 344-1 and 344-m becomes closed. The shift register pulses SRP1 and SRPm are not supplied to the decoder 142 from the V shift register 141, and only the shift register pulses SRP2 to SRP(m−1) are supplied to the decoder 142, exactly as they are, thereby rendering only the display area β of the pel section 11 active. An image is displayed in the display area β. At this time, pel lines a1, a2, a(M−1), and aM are displayed as dark.

A second comparative example (for comparison with the vertical drive circuit 34 according to the third embodiment) will now be described.

Figure 13:
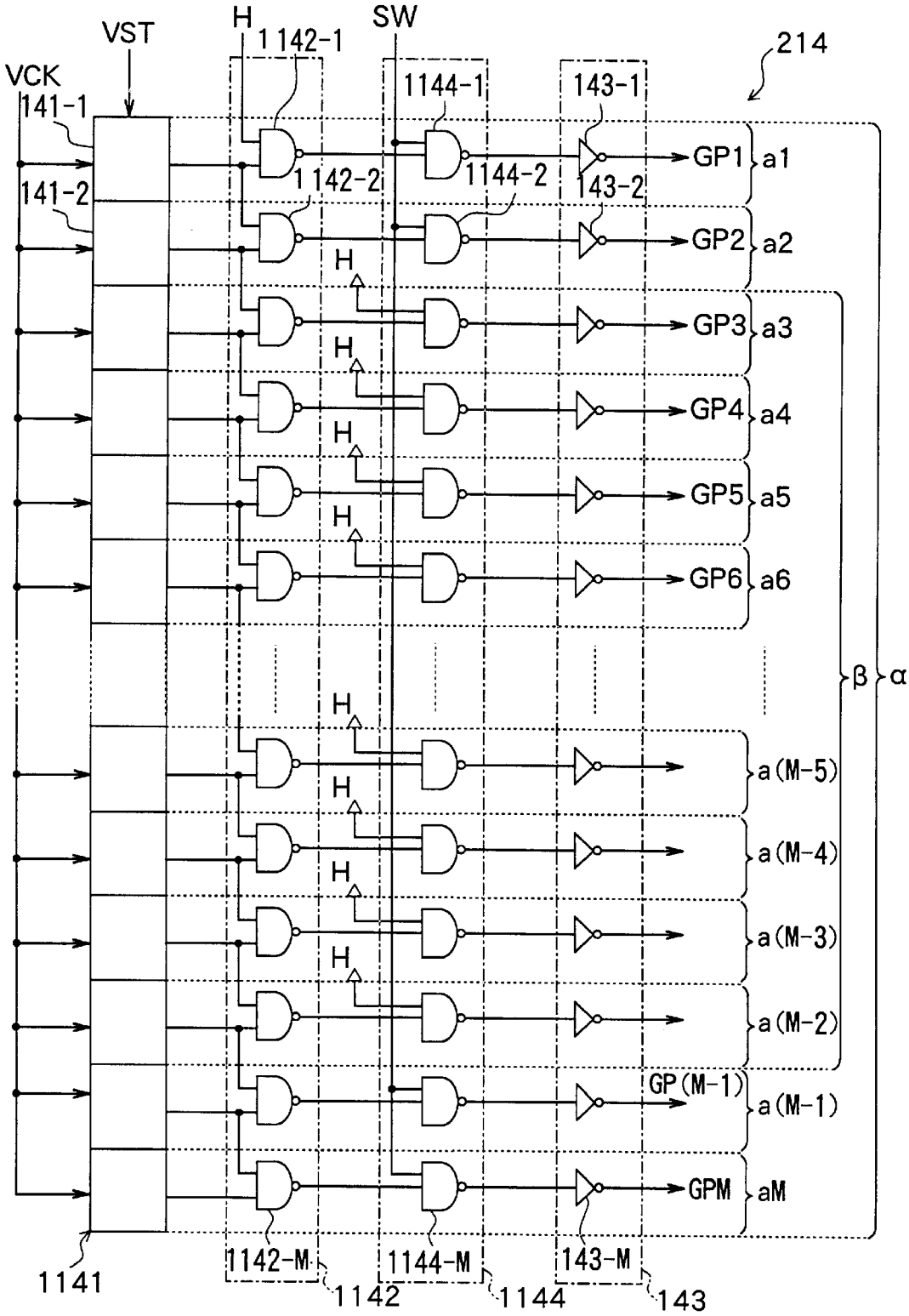
FIG. 13 is a circuit diagram showing the schematic configuration of a vertical drive circuit for comparison with the vertical drive circuit according to the third embodiment.

FIG. 13 shows the schematic structure of a vertical drive circuit 214 of the second comparative example. The vertical drive circuit 214 corresponds to a structure in which a display changeover circuit 1144 is provided between the decoder 1142 and the buffer 143 of the vertical drive circuit 114 shown in FIG.6 of the first comparative example. The display changeover circuit 1144 is capable of switching between the display area α and the display area β within the pel section 11 (FIG. 2) according to the type (or standard) of an input video signal. The display areas α and β are the same as those of the third embodiment (FIG. 12). The display changeover circuit 1144 comprises M NAND gates 1144-1 to 1144-M. Each NAND gate 1144-j (j=1 to M) is provided so as to correspond to each pel line $a_j$ of the pel section 11.

The NAND gate 1144-j controls whether or not a signal output from the NAND gate 1142-j of the decoder section 1142 is input to the corresponding buffer 143-j of the buffer section 143 in the following stage. The signal output from the NAND gate 1142-j of the decoder 1142 is input to either of two input terminals of the NAND gate 1144-j. The display changeover signal SW that assumes a high- or low-level value is input to the remaining input terminal of each of the top two NAND gates 1144-1 and 1144-2 and the bottom two NAND gates 1144-(M−1) and 1144-M. The remaining input terminal of each of the remaining NAND gates 1144-3 to 1144-(M−2) is fixed to a high level. In other respects, the vertical drive circuit 214 is identical in structure with the vertical drive circuit 114 (FIG. 6).

In the vertical drive circuit 214 having such a configuration, in order to make the display area α active, the display changeover signal SW is brought to a high level, whereby signals output from each of the NAND gates 1142-j of the decoder 1142 are supplied to the corresponding buffer 143-j of the buffer 143, exactly as they are, thereby rendering the display area α active. In contrast, in order to make the display area β active, the display changeover signal SW is brought to a low level. Each of the top two NAND gates 1144-1 and 1144-2 and the bottom two NAND gates 1144-(M−1) and 1144-M is closed, whereby signals output from these four NAND gates are not supplied to the buffer 143. Only signals output from the NAND gates 1144-3 to 1144-(M−2) are supplied to the decoder 142, exactly as they are. As a result, only the display area β becomes active, and the pel lines a1, a2, a(M−1), and aM are displayed as dark.

As mentioned above, in the second comparative example, the display changeover circuit 1144 is formed by providing the NAND gates 1144-1 to 1144-M for the purpose of changing a display so as to correspond to the individual pel lines $a_j$ in the pel section 11. Realizing a reduction in pel pitch becomes more difficult in the vertical drive circuit 214 than in the vertical drive circuit 14 according to the first embodiment (FIG. 3). Further, since many transistor elements are required for constituting the display changeover circuit 1144, the amount of electric current to be dissipated becomes greater.

In contrast, in the vertical drive circuit 34 according to the third embodiment (FIG. 12), the display changeover circuit 344 is constituted by providing the NAND gate 1144-k so as to correspond to the pulse transfer stage 141-k provided for the two pel lines a(2k−1) and a(2k). Accordingly, the vertical drive circuit 34 more easily copes with miniaturization of pel pitch than does the vertical drive circuit of the second comparative example (FIG. 13). Further, the number of transistor elements required for constituting the display changeover circuit 344 can be diminished, and the amount of electric current to be dissipated can be reduced to a much greater than in the second comparative example (FIG. 13).

The explanation of the third embodiment has described the case where the display areas are switched through use of the display changeover circuit 344 provided in the vertical drive circuit 14 according to the first embodiment. Alternatively, switching between display areas can be effected by incorporating the display changeover circuit into the vertical drive circuit 24 according to the second embodiment (FIG. 10). In this case, in the vertical drive circuit 24 shown in FIG. 10, the display changeover circuit may be configured by providing one NAND gate between the pulse transfer stage 141-p (p=1−ml) of the V shift register 241 and the three corresponding NAND gates 242-(3p−2), 242-(3p−1), and 242-3p of the decoder 242.

Although the present invention has been described by reference to several embodiments, the present invention is not limited to these embodiments and may be subjected to various modifications. For example, in the second embodiment, the V shift register 241 is configured by providing one pulse transfer stage 241-p for three pel lines a(3p−2), a(3p−1), and a(3p) of the pel section 11. However, one pulse transfer stage may be provided for four or more pel lines.

In the preceding first through third embodiments, three dots are simultaneously sampled during horizontal scanning of pels; however, the present invention is not limited to such a scanning method. Alternatively, a larger number of pels may be driven simultaneously through multi-dot simultaneous sampling or pels may be driven one by one.

Although the embodiments have described the color LCD device, the present invention is not limited to such a device and may be applied to a black-and-white LCD device. Further, the present invention can be applied to a display device other than the liquid crystal device, e.g., a plasma display (PD) element, an electroluminescence (EL) element, or a field-emission display (FED) element. In the field-emission display element, a plurality of minute electron sources are provided in an array pattern as cathodes, and a high voltage is applied to the individual cathodes, thereby extracting electrons. The thus-extracted electrons strike a fluorescent substance applied to the anode, thereby causing the fluorescent substance to glow.

As has been described, according to the pel drive circuit, the combination pel-drive-circuit/pel-integrated device, and the liquid display device incorporating the combination pel-drive-circuit/pel-integrated device of the present invention, pulse shift means for sequentially outputting a first pulse signal while shifting the pulse signal in units comprising a plurality of pels is provided in one of two directions of a pel array. Further, individual drive pulse generation means generate, on the basis of a first pulse signal, a larger number of second pulse signals for individually driving pel lines arranged in the other of the two directions. As a result, the number of circuit elements constituting the pulse shift means can be diminished. Therefore, the area in which circuit elements for constituting the pulse shift means is provided can be reduced, and power consumption can also be diminished. Further, the pulse shift means is required to output only the single first pulse signal to a plurality of pel lines. Consequently, the frequency responses required for circuit elements constituting the pulse shift means can be made less rigorous.

Particularly, according to the combination pel-drive-circuit/pel-integrated device and a liquid display device incorporating the combination pel-drive-circuit/pel-integrated device of the present invention, the number of circuit elements constituting the pulse shift means can be diminished, thereby enabling a reduction in the area within which the circuit elements are positioned. Even when the pel section and a circuit for driving the pel section are formed integrally into a single unit, the present invention yields the advantage of the ability to sufficiently reduce pel pitch.

Further, according to the present invention, a pel drive circuit, a combination pel-drive-circuit/pel-integrated device, and a liquid display device incorporating the combination pel-drive-circuit/pel-integrated device are configured such that changeover means capable of selectively providing a first pulse received from pulse shift means to individual pulse generation means is provided between the pulse drive means and the individual drive pulse means. In contrast with the case of a conventional pel drive circuit configured so as to have changeover means provided between individual drive pulse generation means and individual pel lines, in the drive circuit, the pel-integrated device, and the LCD device according to the present invention, the number of elements constituting the changeover circuit can be reduced. As a result, the circuits can be made more compact. The present invention yields the advantage of the ability to reduce power consumption and pel pitch as compared with the case of a conventional liquid crystal display device, even when a display area can be switched in size by selectively rendering a portion of the whole pels inactive by means of a changeover circuit.

Obviously, many modifications and variations of the present invention are possible in the light of the above teachings. Therefore, it is to be understood that, within the scope of the appended claims, the invention may be practiced through embodiments other than as specifically described.

What is claimed is:

1. A pel drive circuit for driving a plurality of pels arranged in two different directions, comprising:

pulse shift means which sequentially outputs a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions.

2. The pel drive circuit as defined in claim 1, further comprising changeover means provided between the pulse drive means and the individual drive pulse generation means and which can selectively effect supply of the first pulse signal from the pulse shift means to the individual drive pulse generation means.

3. A combination pel-drive-circuit/pel-integrated device, comprising:

a plurality of pels arranged in two different directions;

pulse shift means for sequentially outputting a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions.

4. The combination pel-drive-circuit/pel-integrated device as defined in claim 3, further comprising changeover means which is provided between the pulse drive means and the individual drive pulse generation means and which can selectively effect supply of the first pulse signal from the pulse shift means, to the individual drive pulse generation means.

5. A liquid crystal display device comprising:

a first substrate on which a plurality of pels are arranged in two different directions and on which a drive circuit is formed around the plurality of pels, wherein the drive circuit comprises pulse shift means for sequentially outputting a first pulse signal while shifting the first pulse signal in one of the two directions in units comprising a plurality of pels; and individual drive pulse generation means which generates, on the basis of the first pulse signal output from the pulse shift means, a larger number of second pulse signals for individually driving pel lines arranged in the other of the two directions;

a second substrate placed so as to oppose and be spaced a given interval away from the first substrate; and a liquid crystal layer held between the first and second substrates.

6. The liquid crystal display device as defined in claim 5, further comprising changeover means which is provided between the pulse shift means and the individual drive pulse generation means and which can selectively effect supply of the first pulse signal from the pulse shift means to the individual drive pulse generation means.

* * * * *